US006076730A

United States Patent [19]

Boutin et al.

[11] Patent Number: 6,076,730

[45] Date of Patent: Jun. 20, 2000

[54] CARTON WITH LOCKING MECHANISM

[75] Inventors: John Randall Boutin, Youngsville; Tony Joseph Abshire, Broussard, both of La.; Brian Keith Jambois, Mechanicsville, Va.

[73] Assignee: International Paper Company, Purchase, N.Y.

[21] Appl. No.: 09/295,877

[22] Filed: Apr. 21, 1999

Related U.S. Application Data

[60] Provisional application No. 60/084,301, May 5, 1998.

[51] Int. Cl.[7] ..... B65D 5/10

[52] U.S. Cl. ..... 229/157; 229/103.2; 229/185

[58] Field of Search ..... 229/103.2, 156, 229/157, 185; 206/427, 434

[56] References Cited

U.S. PATENT DOCUMENTS 1,546,601 7/1925 Morris .
2,970,741 2/1961 Stone et al. .
2,973,129 2/1961 Stone et al. .
3,374,937 3/1968 Wilson .
3,455,498 7/1969 Gadiel .
3,539,090 11/1970 Blasdell .
5,328,088 7/1994 Lonczak .

*Primary Examiner*—Gary E. Elkins
*Attorney, Agent, or Firm*—Watov & Kipnes, P.C.

[57] ABSTRACT

A carton and blank for forming the same including a plurality of spaced apart sections having respective end panels, at least one locking mechanism including a notch formed in one of the end panels and an edge portion formed in an adjacent end panel, each edge portion having a slanted portion and a straight portion forming a junction with the junction being insertable into the notch when the sections are folded together.

48 Claims, 2 Drawing Sheets

CARTON WITH LOCKING MECHANISM

RELATED APPLICATION

This application claims the benifit of U.S. Provisional Patent Application Ser. No. 60/084,301 filed May 5, 1998.

FIELD OF THE INVENTION

The present invention is directed to a carton formed from a blank having foldable sections in which the top panels of each of the sections cooperate to engage each other through a locking mechanism. Spaced apart top panels are provided with notches at the ends thereof and alternating spaced apart top panels include edge portions such that the edge portions interlock with the notches to secure the foldable sections into place and thereby form a sturdy carton.

SUMMARY OF THE INVENTION

The present invention is generally directed to a carton formed from a blank having sections which are foldable along parallel fold lines. At least one pair of panels include a locking mechanism enabling the sections to be folded into an interlocking relationship through the locking mechanism to provide a sturdy carton. In a particular aspect of the present invention spaced apart panels of one pair of sections are provided with notches at opposed ends thereof which can receive and thereby lock the corresponding spaced apart panels of the other pair of sections through an edge portion. The edge portions of the spaced apart panels which are insertable into the notches are comprised of a slanted portion and a straight portion which come together at a junction defining an obtuse angle. The respective junctions of the pair of spaced apart panels lockingly engage the notches of the other pair of spaced apart panels to thereby secure the carton in place when the sections are folded into the form of a carton without the need for glues, adhesives, staples or other similar securing devices.

In a preferred form of the invention the notches are formed from converging cutlines that meet at a junction which is curvilinear. In another preferred form of the invention, the slanted portion of the edge portion is curvilinear to provide greater resistance to tearing. In a further preferred form of the invention, a gap is provided between the slanted portion and the straight portion to provide enhanced interlocking between the edge portion and the notch.

BRIEF DESCRIPTION OF THE DRAWINGS

The following drawings in which like reference characters illustrate like parts is illustrative of embodiments of the invention and are not intended to limit the invention as encompassed by the claims forming part of the application.

DETAILED DESCRIPTION OF THE INVENTION

Figure 1:
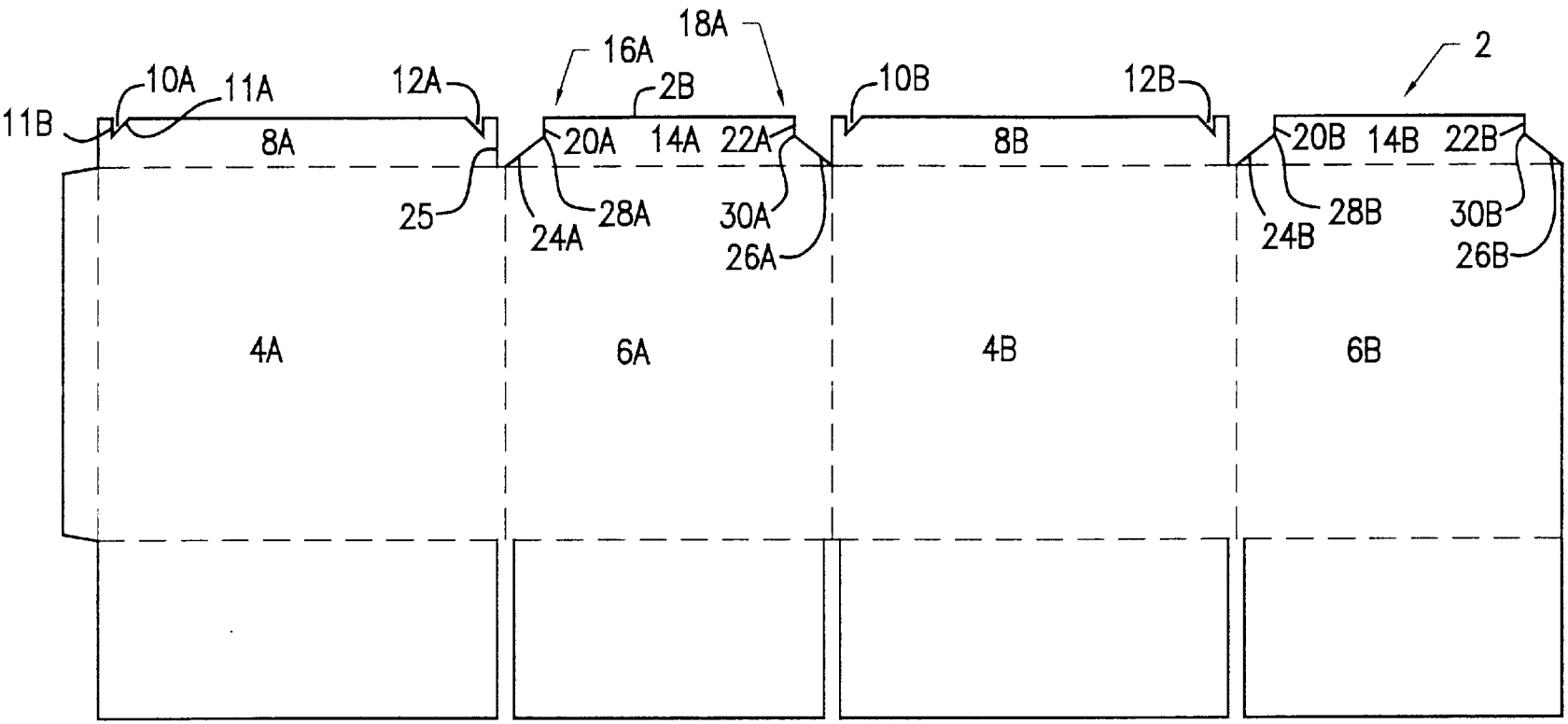
FIG. 1 is a plan view of a blank for forming an embodiment of a carton in accordance with the present invention.

The present invention is generally directed to a carton formed from a blank which includes a locking mechanism. The blank includes a plurality of foldable sections, typically four sections. End panels are included in each of the four sections which interact with each other to thereby lock the sections in place when the sections are folded upon each other along fold lines to form the carton. Referring to FIG. 1, there is shown a blank 2 comprising four foldable sections wherein Sections 4A and 4B constitute a first pair of spaced apart sections and Sections 6A and 6B constitute a second pair of spaced apart sections. The number of sections may be greater than four to form a polygonal shaped carton. However, for the purpose of illustrating the present invention, a four section carton will be exemplified.

The first pair of spaced apart Sections 4A and 4B each have a corresponding end panel 8A and 8B, respectively constituting spaced apart end panels with each end panel having a pair of spaced apart notches. More specifically, end panel 8A is provided with spaced apart notches 10A and 12A and end panel 8B is provided with spaced apart notches 10B and 12B. The positioning of the notches is chosen so that the notches may interlock with corresponding edge portions of adjacent panels.

Figure 2:
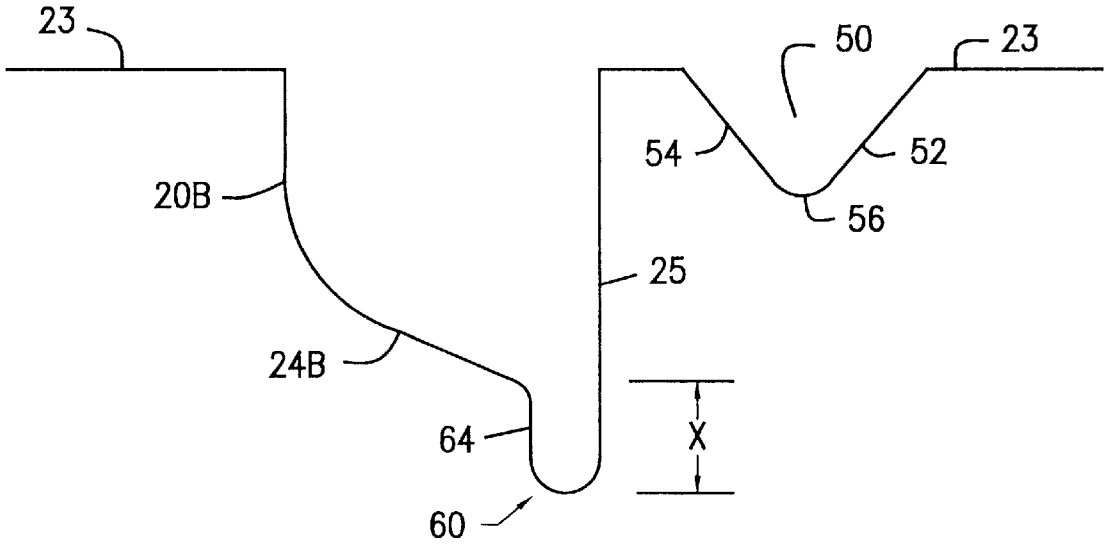
FIG. 2 is a partial plan view of adjacent panels showing a further embodiment of the locking mechanism in accordance with the present invention.

The notches 10A, 12A, 10B and 10B are formed from converging cutlines 11A and 11B as specifically shown for the notch 10A. As explained hereinafter, the cutlines 11A and 11B may be straight and thereby form a V-shaped notch shown in FIG. 1 or may have a curvilinear shape wherein the cutlines converge to form a somewhat rounded junction as shown in FIG. 2 and as described hereinafter.

The Sections 6A and 6B are provided with corresponding spaced apart end panels 14A and 14B. Each of the end panels 14A and 14B is provided with an edge portion comprised of a slanted portion and a straight portion to form a junction therebetween. As used herein the term "straight portion" shall mean that the straight portion is at least substantially perpendicular to the edge 23 of the respective top panel (e.g. end panel 14A). The term "slanted portion" shall mean that the slanted portion is not perpendicular to the edge 23 but rather forms an obtuse angle at the junction with the straight portion.

More specifically, end panel 14A is provided with opposed edge portions 16A and 18A. Each of the respective edge portions 16A and 18A is provided with respective straight portions 20A and 22A. As previously explained the straight portions are at least substantially perpendicular to the edge 23 of the end panel 14A. Extending from the straight portions 20A and 22A are slanted portions 24A and 26A, respectively. Portions 20A and 24A join at a junction 28A while the portions 22A and 26A join at a junction 30A. The angle formed between the portions 20A and 24A as well as the portions 22A and 26A is an obtuse angle, typically about 135°. As explained with reference to FIG. 2, the junction (e.g. 28A) between the slanted portion and the straight portion may be curvilinear to better avoid tearing from the locking operation.

As shown in FIG. 1, the end of the slanted portion (e.g. 24A) opposed form the junction (e.g. 28A) terminates adjacent a short edge 25 of the adjacent end panel 8A with sufficient clearance to enable the locking mechanism of adjacent panels to interlock and the carton to thereby be formed.

The panel 14B is constructed in a manner similar to panel 14A. In particular, straight portions 20B and 22B are joined by slanted portions 24B and 26B at respective junctions 28B and 30B so that the portions 20B and 24B and 22B and 26B, respectively, form an obtuse angle as previously described. The junctions 28B and 30B as explained above may be curvilinear as well.

In operation, when the respective Sections 4A, 6A, 4B and 6B are folded together to form a container, the panels 8A and 8B are folded downwardly followed by panels 14A and 14B. As a consequence, the junction 28A of panel 14A engages notch 12A of panel 8A to lock the respective panels together. Similar locking engagements are obtained by the interaction of junction 30A and notch 10B, junction 28B and notch 12B and junction 30B and notch 10A, respectively when the sections 4A, 6A, 4B and 6B are folded to form the carton.

As previously described, the junctions 28A, 28B, 30A and 30B may be curvilinear as shown in FIG. 2. Referring specifically to FIG. 2 there is shown an edge portion 40 having a straight portion 42 and a slanted portion 44 which join at a junction 46. It will be noted that the junction 46 is curvilinear.

FIG. 2 also shows that the notch which enters locking engagement with the edge portion may be formed from cutlines which form a curvilinear junction. Referring again to FIG. 2 a notch 50 is formed from opposed converging cutlines 52 and 54 which converge at the junction 56. The junction 56 has a curvilinear form and constitutes a preferred embodiment of the present invention.

In another and preferred embodiment of the invention a gap is provided between the slanted portion and the short edge of the adjacent portion for enhanced locking of the edge portion and the notch. Referring to FIG. 2 there is provided a U-shaped gap 60 forming by extending the short edge 25 a distance "x" and by extending the slanted portion 62 downwardly by a leg 64 to form a U-shaped gap. The presence of the gap 60 to provide a more uniform operation of the locking mechanism.

What is claimed:

1. A carton comprising a plurality of spaced apart sections having respective end panels at least one locking mechanism comprising a notch formed in one of said end panels and an edge portion formed in an adjacent end panel, each edge portion having a slanted portion and a straight portion forming a first junction therebetween, each notch formed from converging cutlines forming a second junction therebetween having a curvilinear shape, said first junction being insertable into said notch when the sections are folded together.

2. The carton of claim 1 wherein the first junction between the slanted portion and the straight portion is curvilinear.

3. The carton of claim 1 wherein the slanted portion and the straight portion converge to form an obtuse angle.

4. The carton of claim 1 comprising a first end panel having a long edge and a short edge said notch being formed in the long edge, said edge portion being formed in the second panel and a gap formed between the edge portion and the short edge of the first panel.

5. The carton of claim 4 wherein the gap is U-shaped.

6. The carton of claim 1 comprising four foldable sections, each section having an end panel, one pair of spaced apart end panels having a notch, and an alternating spaced apart end panels having said edge portion.

7. The carton of claim 6 wherein the first junction between the slanted portion and the straight portion is curvilinear.

8. The carton of claim 6 wherein the slanted portion and the straight portion converge to form an obtuse angle.

9. A blank foldable into a carton comprising a plurality of spaced apart sections having respective end panels, at least one locking mechanism comprising a notch formed in one of said end panels and an edge portion formed in an adjacent panel, each edge portion having a slanted portion and a straight portion forming a first junction therebetween, each notch formed from converging cutlines forming a second junction therebetween having a curvilinear shape, said junctions being insertable into said notches when the sections are folded together to form said carton.

10. The blank of claim 9 wherein the first junction between the slanted portion and the straight portion is curvilinear.

11. A carton comprising a plurality of spaced apart sections having respective end panels, at least one locking mechanism comprising a notch formed in one of said end panels and an edge portion formed in an adjacent end panel, each edge portion having a slanted portion and a straight portion which converge to form an obtuse angel thereby forming a first junction therebetween, said first junction being insertable into said notch when the sections are folded together.

12. The carton of claim 11 wherein the notch is V-shaped.

13. The carton of claim 11 wherein the notch is formed from converging cutlines.

14. The carton of claim 11 wherein the first junction between the slanted portion and the straight portion is curvilinear.

15. The carton of claim 11 comprising a first end panel having a long edge and a short edge, said notch being formed in the long edge, said edge portion being formed in the second panel and a gap formed between the edge portion and the short edge of the first panel.

16. The carton of claim 15 wherein the gap is U-shaped.

17. The carton of claim 11 comprising four foldable sections, each section having an end panel, one pair of spaced apart end panels having a notch, and an alternating spaced apart end panels having said edge portion.

18. The carton of claim 17 wherein the notch is V-shaped.

19. The carton of claim 17 wherein the notch is formed from converging cutlines.

20. The carton of claim 19 wherein the cutlines join at a second junction having a curvilinear shape.

21. The carton of claim 17 wherein the first junction between the slanted portion and the straight portion is curvilinear.

22. The carton of claim 17 wherein the slanted portion and the straight portion converge to form an obtuse angle.

23. A blank foldable into a carton comprising a plurality of spaced apart sections having respective end panels, at least one locking mechanism comprising a notch formed in one of said end panels and an edge portion formed in an adjacent panel, each edge portion having a slanted portion and a straight portion which converge to form an obtuse angle thereby forming a first junction therebetween, said junctions being insertable into said notches when the sections are folded together to form said carton.

24. The blank of claim 23 wherein the notch is V-shaped.

25. The blank of claim 23 wherein the notch is formed from converging cutlines.

26. The blank of claim 25 wherein the cutlines join at a second junction having a curvilinear shape.

27. The blank of claim 23 wherein the first junction between the slanted portion and the straight portion is curvilinear.

28. A carton comprising a plurality of spaced apart sections having respective end panels, at least one locking mechanism comprising a notch formed in a first end panel having a long edge and a short edge, said notch being formed in the long edge and an edge portion formed in an adjacent second end panel with a gap formed between the edge portion and the short edge of the first end panel, each edge portion having a slanted portion and a straight portion forming a first junction therebetween, said first junction being insertable into said notch when the sections are folded together.

29. The carton of claim 28 wherein the notch is V-shaped.

30. The carton of claim 28 wherein the notch is formed from converging cutlines.

31. The carton of claim 28 wherein the first junction between the slanted portion and the straight portion is curvilinear.

32. The carton of claim 28 wherein the gap is U-shaped.

33. The carton of claim 28 comprising four foldable sections, each section having an end panel, one pair of spaced apart end panels having a notch, and alternating spaced apart end panels having said edge portion.

34. The carton of claim 33 wherein the notch is V-shaped.

35. The carton of claim 33 wherein the notch is formed from converging cutlines.

36. The carton of claim 35 wherein the cutlines join at a second junction having a curvilinear shape.

37. The carton of claim 33 wherein the first junction between the slanted portion and the straight portion is curvilinear.

38. The carton of claim 33 wherein the slanted portion and the straight portion converge to form an obtuse angle.

39. A blank foldable into a carton comprising a plurality of spaced apart sections having respective end panels, at least one locking mechanism comprising a notch formed in a first end panel having a long edge and a short edge, said notch being formed in the long edge and an edge portion formed in an adjacent second end panel with a gap formed between the edge portion and the short edge of the first end panel, each edge portion having a slanted portion and a straight portion forming a first junction therebetween, said junctions being insertable into said notches when the sections are folded together to form said carton.

40. The blank of claim 39 wherein the notch is V-shaped.

41. The blank of claim 39 wherein the notch is formed from converging cutlines.

42. The blank of claim 41 wherein the cutlines join at a second junction having a curvilinear shape.

43. The blank of claim 39 wherein the first junction between the slanted portion and the straight portion is curvilinear.

44. The blank of claim 39 wherein the slanted portion and the straight portion converge to form an obtuse angle.

45. A carton comprising four foldable sections having respective end panels, at least one locking mechanism comprising a notch formed in one pair of foldable spaced apart end panels and an edge portion formed in another pair of adjacent foldable spaced apart end panels, each edge portion having a slanted portion and a straight portion forming a first junction therebetween, each notch formed from converging cutlines forming a second junction therebetween having a curvilinear shape, said first junction being insertable into said notch when the sections are folded together.

46. The carton of claim 45 wherein the first junction between the slanted portion and the straight portion is curvilinear.

47. The carton of claim 45 wherein the slanted portion and the straight portion converge to form an obtuse angle.

48. A carton comprising four foldable sections having respective end panels, at least one locking mechanism comprising a notch formed in one pair of foldable spaced apart end panels and an edge portion formed in another pair of adjacent foldable spaced apart end panels, each edge portion having a slanted portion and a straight portion which converge to form an obtuse angle to thereby form a first junction therebetween, said first junction being insertable into said notch when the sections are folded together.

* * * * *